US005266457A

United States Patent [19]

Kojima et al.

[11] Patent Number: 5,266,457

[45] Date of Patent: Nov. 30, 1993

[54] SILVER HALIDE PHOTOGRAPHIC MATERIAL

[75] Inventors: Tetsuro Kojima; Hiroyuki Mifune, both of Kanagawa, Japan

[73] Assignee: Fuji Photo Film Co., Ltd., Kanagawa, Japan

[21] Appl. No.: 990,260

[22] Filed: Dec. 14, 1992

[30] Foreign Application Priority Data

Dec. 13, 1991 [JP] Japan ..... 3-351206

[51] Int. Cl.[5] ..... G03C 1/09

[52] U.S. Cl. ..... 430/601; 430/603

[58] Field of Search ..... 430/601, 603

[56] References Cited

U.S. PATENT DOCUMENTS 4,115,129 9/1978 Bigelow ..... 430/601

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photographic material comprises a silver halide emulsion layer provided on a support. In the photographic material of the present invention, the silver halide emulsion layer contains a compound represented by the formula (I):

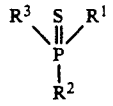

(I)

in which each of $R^1$, $R^2$ and $R^3$ independently is a group of chain structure selected from an alkyl group, an alkenyl group, an alkynyl group and an alkylthio group, each of which may have one or more substituent groups; and the number of the carbon atoms contained in the compound represented by the formula (I) is 3 to 12. A process for sulfur sensitization of a silver halide emulsion using the compound represented by the formula (I) is also disclosed.

11 Claims, No Drawings

SILVER HALIDE PHOTOGRAPHIC MATERIAL

FIELD OF THE INVENTION

The present invention relates to a silver halide photographic material and a process for sulfur sensitization of a silver halide emulsion.

BACKGROUND OF THE INVENTION

A silver halide photographic material comprises a silver halide emulsion layer provided on a support. The silver halide emulsion is usually chemically sensitized to obtain a desired sensitivity or gradation. Examples of the chemical sensitizer include a sulfur sensitizer, a selenium sensitizer, a tellurium sensitizer, a noble metal (such as gold) sensitizer, a reduction sensitizer and a combination thereof. The sulfur sensitizer has been most frequently used in a conventional photography. The sulfur sensitizer is a labile sulfur compound which reacts with silver ion to form silver sulfide. The sulfur sensitizer is described in P. Grafkides, Chimie et Physique Photographique (Paul Montel, 1987, fifth edition); T. H. James, The Theory of The Photographic Process (Macmillan, 1977, fourth edition); and H. Frieser, Die Grundlagender Photographischen Prozess mit Silverhalogeniden (Akademische Verlagsgeselbshaft, 1968).

Examples of the conventional sulfur sensitizers include thiosulfates (e.g., sodium thiosulfate); thiosulfonates (e.g., p-toluenethiosulfonate); thioureas (e.g., allylthiourea, N,N'-diphenylthiourea, triethylthiourea, acethylthiourea, N-ethyl-N'-(4-methyl-2-thiazolyl)thiourea); thioamides (e.g., thioacetamide, N-phenylthioacetamide); rhodanines (e.g., rhodanine, N-ethylrhodanine, 5-benzylidenerhodanine, 5-benzylidene-N-ethylrhodanine); thiohydantoins; 4-oxo-oxazolidine-2-thiones; dipolysulfides; thiosulfonic acids; mercapto compounds (e.g., cysteine); polythionates; sulfur of simple body; and sodium sulfide.

Further, U.S. Pat. No. 4,115,129 (Bigelow) discloses an organophosphine sulfide as a sulfur sensitizer. The sensitizer should be used at a pH of at least 7. The organophosphine sulfide is represented by the formula:

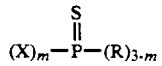

wherein (A) R is individually selected from hydrogen and a monovalent organic radical; m is 0, 1 or 2, and not more than one of said R's is hydrogen when m is 0; and X represents a group having the formula:

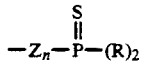

where Z is a divalent organic radical, and n is 0 or 1, or (B) $(x)_m$ and $(R)_{3-m}$ together comprises a single trivalent heterocyclic radical.

Examples (31) of the organophosphine sulfide are disclosed at columns 4 and 5 in U.S. Pat. No. 4,115,129. Most of the examples (22) are relatively large molecular compounds having 13 or more carbon atoms. The other nine examples having 12 or less carbon atom are shown below.

No. 1

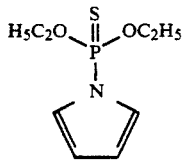

No. 2

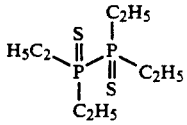

No. 3

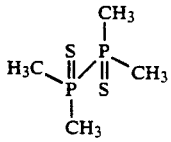

No. 8

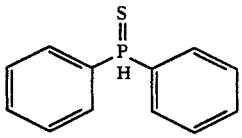

No. 10

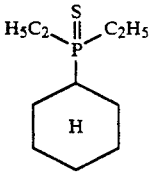

No. 16

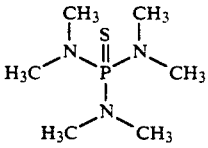

No. 17

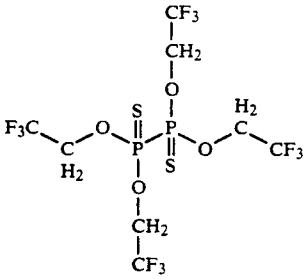

No. 21

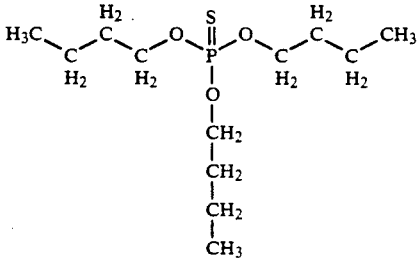

-continued

No. 28

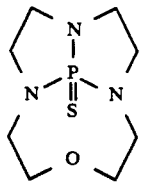

The organophosphine sulfides disclosed in U.S. Pat. No. 4,115,129 have also been known as supersensitizers, as is disclosed in U.S. Pat. No. 3,895,951 (Riester et al.).

By the way, the chemical sensitization is greatly influenced by external conditions such as pH, pAg, temperature and time. Accordingly, the conditions are preferably kept constant to obtain a good reproducibility of photographic products. However, it is practically difficult to obtain a constant value of pH or pAg in preparation of silver halide emulsions. Therefore, a sulfur sensitizer is required to sensitize a silver halide emulsion constantly, even if the pH and pAg conditions are changed. The above-mentioned conventional sulfur sensitizers do not satisfy the requirement. For example, as is shown in Example 1 (cf., Table 1) of the present specification, thioureas, thioamides and rhodanines are unstable with respect to the sensitivity of a silver halide emulsion when the pH of the emulsion is changed, while thiosulfates are relatively stable. On the other hand, thiosulfates, thioureas and thioamides (particularly thiosulfates) are unstable when the pAg of the emulsion is changed, while rhodanines are relatively stable, as is shown in Example 2 (cf., Table 2). It might be concluded from these results that a small molecular sulfur sensitizer (e.g., thiosulfates) is unstable when the pAg of the emulsion is changed, while a relatively large molecular sulfur sensitizer (e.g., rhodanines) is unstable when the pH of the emulsion is changed.

Examples of the organophosphine sulfide disclosed in U.S. Pat. No. 4,115,129 are unstable when the pH of the emulsion is changed, as is shown in Example 4 (cf., Table 4) in the present specification. Accordingly, U.S. Pat. No. 4,115,129 describes that the sensitizer should be used at a pH of at least 7.

SUMMARY OF THE INVENTION

As is mentioned above, a sulfur sensitizer is required to sensitize a silver halide emulsion constantly, even if the pH and pAg conditions are changed.

An object of the present invention is to provide a silver halide photographic material improved in antifogging property, reproducibility and sensitivity.

Another object of the invention is to provide a process for sulfur sensitization of a silver halide emulsion using a new sulfur sensitizer which is stable even if pH or pAg conditions are changed.

There is provided by the present invention a silver halide photographic material which comprises a silver halide emulsion layer provided on a support, wherein the silver halide emulsion layer contains a compound represented by the formula (I):

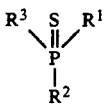

(I)

in which each of $R^1$, $R^2$ and $R^3$ independently is a group of chain structure selected from an alkyl group, an alkenyl group, an alkynyl group and an alkylthio group, each of which may have one or more substituent groups; and the number of the carbon atoms contained in the compound represented by the formula (I) is 3 to 12.

There is also provided by the invention a process for sulfur sensitization of a silver halide emulsion, wherein the silver halide emulsion is sensitized with a compound represented by the formula (I).

The present inventors found the new sulfur sensitizer represented by the formula (I). The function of the sulfur sensitizer is stable, even if the pH and pAg conditions are changed. It is a surprising effect that the sulfur sensitizer represented by the formula (I) is stable to the pH condition though the sensitizer has a relatively small molecular weight (the number of the total carbon atoms is 3 to 12).

Therefore, the sulfur sensitization of the present invention using the sulfur sensitizer represented by the formula (I) is stable even if pH or pAg conditions are changed. Further, the silver halide photographic material of the invention is improved in antifogging property, reproducibility and sensitivity.

DETAILED DESCRIPTION OF THE INVENTION

The silver halide photographic material of the present invention is characterized in that the silver halide emulsion layer contains a compound represented by the following formula (I).

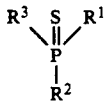

(I)

In the formula (1), each of $R^1$, $R^2$ and $R^3$ independently is a group of chain structure selected from an alkyl group, an alkenyl group, an alkynyl group and an alkylthio group, each of which may have one or more substituent groups; and the number of the carbon atoms contained in the compound represented by the formula (I) is 3 to 12.

The group of chain structure means an acyclic group. Accordingly, an alicyclic group (such as cycloalkyl) is excluded from the meaning of the group of chain structure.

The alkyl group has 1 to 10 carbon atoms, and preferably has 1 to 4 carbon atoms. Examples of the alkyl group include methyl, ethyl, n-propyl, isopropyl, isobutyl, carboxymethyl, methoxyethyl, dimethylaminoethyl, n-hexyl, n-octyl, n-decyl and sulfoethyl.

The alkenyl group has 2 to 10 carbon atoms, and preferably has 2 to 4 carbon atoms. Examples of the alkenyl group include vinyl, allyl and butenyl.

The alkynyl group has 2 to 10 carbon atoms, and preferably has 2 to 4 carbon atoms. Examples of the alkynyl group include propargyl and butynyl.

The alkylthio group has 1 to 10 carbon atoms, and preferably has 1 to 4 carbon atoms. Examples of the alkylthio group include methylthio, ethylthio, butylthio, hexylthio and decylthio.

Examples of the substituent group of $R^1$, $R^2$ and $R^3$ include cyano, nitro, hydroxyl, a halogen atom (e.g., chlorine, bromine, fluorine), amino, a substituted amino group (e.g., dimethylamino), an alkoxy group (e.g., methoxy, ethoxy), an alkylthio group (e.g., methylthio, ethylthio), an alkoxycarbonyl group (e.g., methoxycarbonyl), an acyloxy group (e.g., acetyloxy), carbamoyl, an amido group (e.g., acetamido), sulfamoyl, a sulfonamido group (methanesulfonamide), ureido, thioureido, carboxyl and sulfo. Carboxyl and sulfo may be in the form of a salt.

Each of $R^1$, $R^2$ and $R^3$ in the formula (I) preferably is a group of chain structure selected from an alkyl group, an alkenyl group and an alkynyl group, more preferably is selected from an alkyl group and an alkenyl group, and most preferably is an acyclic alkyl group.

The number of the carbon atoms contained in the compound represented by the formula (I) is 3 to 12, preferably is 3 to 10, more preferably is 3 to 8, and most preferably is 3 to 6.

Each of $R^1$, $R^2$ and $R^3$ in the formula (I) preferably contains 1 to 4 carbon atom.

Examples of the compound represented by the formula (I) are shown below.

(1)

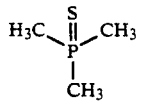

(2)

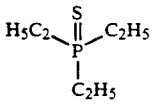

(3)

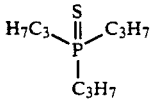

(4)

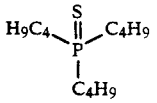

(5)

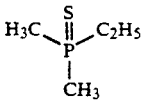

(6)

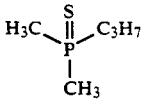

(7)

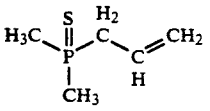

(8)

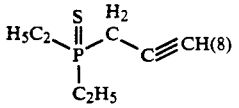

(9)

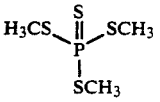

(10)

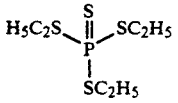

-continued (11)

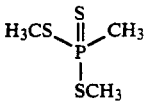

(12)

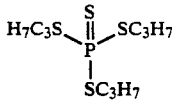

(13)

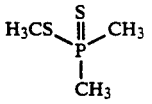

(14)

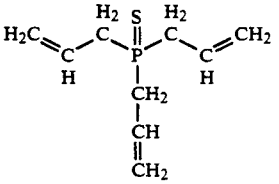

(15)

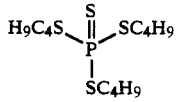

(16)

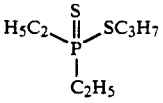

(17)

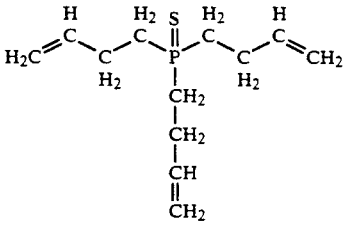

(18)

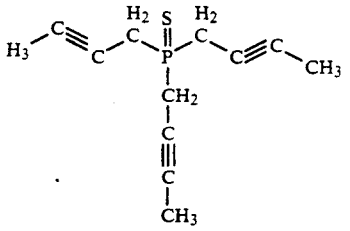

(19)

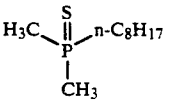

(20)

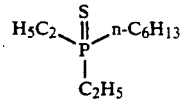

(21)

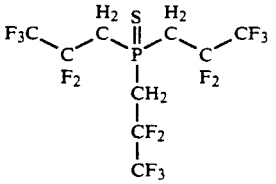

-continued (22)

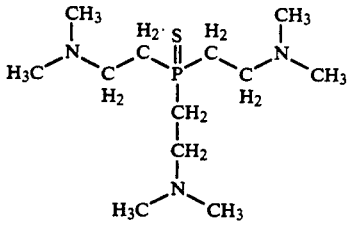

(23)

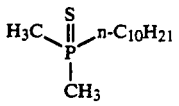

(24)

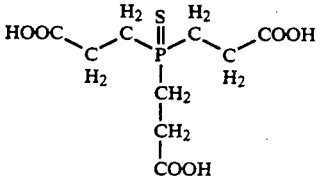

(25)

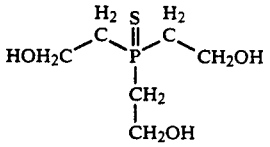

The compound represented by the formula (I) can be synthesized according to the known methods, which are described in Organic Phosphorous Compounds, Vol. 4, 1-73; J.Chem. Soc. Chem. (B) 1416 (1988); J.Org. Chem. 32, 1717 (1967) and 32, 2999 (1967); Tetrahedron 20, 449 (1964); and J.Am. Chem. Soc. 91, 2915 (1969).

The compound represented by the formula (I) may be used in the form of an aqueous solution or a solution in an organic solvent which is miscible with water. Examples of the organic solvents include alcohols, ethers, glycols, ketones, esters and amides.

The amount of the compound represented by the formula (I) depends on the nature of the silver halide grains and the conditions of the chemical sensitization. The amount is preferably in the range of $10^{-7}$ to $10^{-2}$ mol based on 1 mol of the silver halide, and more preferably in the range of $10^{-6}$ to $10^{-3}$ mol.

In the sulfur sensitization, a silver halide emulsion is sensitized preferably at a pH of lower than 7, more preferably at a pH in the range of 3.0 to 6.8, and most preferably at a pH in the range of 4.0 to 6.8. The emulsion is sensitized a pAg preferably in the range of 6 to 11, more preferably in the range of 7 to 10, and most preferably in the range of 7 to 9.5. The silver halide emulsion is sensitized at a temperature preferably in the range of 40° C. to 95° C., and more preferably in the range of 50° C. to 85° C.

In the photographic material of the invention, the silver halide emulsion can be sensitized with another sulfur sensitizer in addition to the compound represented by the formula (I). Examples of the other sulfur sensitizers are described in BACKGROUND OF THE INVENTION of the present specification.

The silver halide emulsion may be subjected to another sensitization such as noble metal sensitization, selenium sensitization, tellurium sensitization and reduction. Two or more sensitizations can be used in combination with the sulfur sensitization of the present invention.

The noble metal uses gold, platinum, palladium or iridium sensitizer. A gold sensitizer is particularly preferred. Examples of the gold sensitizer include chloroauric acid, potassium chloroaurate, potassium aurithiocyanate, gold sulfide and gold selenide. The noble metal sensitizer is preferably used in an amount of $10^{-7}$ to $10^{-2}$ mole based on 1 mole of the silver halide.

The selenium sensitizer is a labile selenium compound. Examples of the selenium sensitizer include colloidal selenium metal; selenoureas (e.g., selenourea, N,N-dimethylselenourea, N,N-diethylselenourea, tetramethylselenourea, N,N,N'-trimethyl-N'-acetylselenourea, N,N,N'-trimethyl-N'-heptafluorocarbonylselenourea, N,N,N'-trimethyl-N'-4-chlorophanylcarbonylselenourea, N,N,N'-trimethyl-N'-4-nitrophanylcarbonylselenourea); selenoamides (e.g., selenoacetamide, N,N-dimethylselenobenzamide); selenoketones (e.g., selenoacetone, selenoacetophenone, bis-(adamantyl)selenoketone); isoselenocyanates (e.g., allylisoselenocyanate); selenocarboxylic acids, (e.g., 2-selenopropionic acid); selenoesters (e.g., methyl 3-selenobutylate); selenides (e.g., dimethyl selenide, diethyl selenide, triphenylphosphine selenide); and selenophosphates (tri-p-trylselenophosphate). The selenium sensitizers are described in Japanese Patent Publications No. 43(1968)-13489 and No. 44(1969)-15748; and Japanese Patent Provisional Publications No. 4(1992)-25832, No. 4(1992)-109240 and No. 4(1992)-147250. The selenium sensitizer is preferably used in an amount of $10^{-8}$ to $10^{-3}$ mol based on 1 mol of the silver halide.

The tellurium sensitizer is a labile tellurium compound. Examples of the tellurium sensitizer include colloidal tellurium metal; telluroureas (e.g., allyltellurourea, N,N-dimethyltellurourea, N,N-diethyltellurourea, tetramethyltellurourea, N-carboxyethyl-N,N-dimethyltellurourea, N,N'-dimethyltellurourea, N,N'-diphenyltellurourea); telluroamides (e.g., telluroacetamide, N,N-dimethyltellurobenzamide); telluroketones (e.g., telluroacetone, telluroacetophenone); isotellurocyanates (e g., allylisotellurocyanate); tellurohydrazides (e.g., N,N',N'-trimethyltellulobenzhydrazide); telluroesters (e.g., t-hexyl t-tellurobutylate); phosphine tellurides (e.g., tributylphosphine telluride, tricyclohexylphosphine telluride, triisopropylphosphine telluride, butyl-diisopropylphosphine telluride, dibutylphenylphosphine telluride); other tellurium compounds disclosed in British Patent No. 1,295,462 (e.g., gelatin containing telluride ion, potassium telluride, potassium tellurocyanate, sodium telluropentathionate, allyl tellurocyanate). The tellurium sensitizers are described in U.S. Pat. No. 1,623,499, No. 3,320,069, No. 3,772,031; British Patents No. 235,211, No. 1,121,496, No. 1,295,462, No. 1,396,696; Canadian Patent No. 1,396,696; J.Chem. Soc. Chem. Commun. 635 (1980), 1102 (1979), 645 (1979); J.Chem. Soc. Perkin. Trans. 1, 2191 (1980); and Japanese Patent Provisional Publication No. 4(1992)-204640. The tellurium sensitizer is preferably used in an amount of $10^{-8}$ to $10^{-3}$ mol based on 1 mol of the silver halide.

Examples of the reduction sensitizer include stannous chloride, aminoiminomethanesulfinic acid, a hydrazine derivative, borane, silane and a polyamine compound.

The silver halide emulsion may be sensitized in the presence of a silver halide solvent. Examples of the silver halide solvent include thiocyanates (e.g., potassium thiocyanate), thioethers (e.g., 3,6-dithia-1,8-octanediol), tetra-substituted thiourea compounds (e.g., tetramethylthiourea), thion compounds, mercapto compounds, mesoionic compounds, selenoethers, telluroethers and sulfites. Ammonia, potassium rhodanide, ammonium rhodanide and amine compounds are also available as the silver halide solvent. A thiocyanate, a thioether, a tetra-substituted thiourea compound and a thion compound are preferred. The thioethers are described in U.S. Pat. No. 3,021,215, No. 3,271,157, No. 3,574,628, No. 3,704,130, No. 4,276,374 and No. 4,297,439, Japanese Patent Publication No. 58(1983)-30571, and Japanese Patent Provisional Publication No. 60(1985)-136736. The tetra-substituted thiourea compounds are described in U.S. Pat. No. 4,221,863 and Japanese Patent Publication No. 59(1984)-11892. The thion compounds are described in Japanese Patent Publication No. 60(1985)-29727, and Japanese Patent Provisional Publications No. 53(1978)-144319, No. 53(1978)-82408 and No. 55(1980)-77737.

The mercapto compounds are described in Japanese Patent Publication No. 63(1988)-29727. The mesoionic compounds are described in Japanese Patent Provisional Publication No. 60(1985)-163042. The selenoethers are described in U.S. Pat. No. 4,782,013. The telluroethers are described in Japanese Patent Provisional Publication No. 2(1990)-118566. The amine compounds are described in Japanese Patent Provisional Publication No. 54(1979)-100717. The silver halide solvent is preferably used in an amount of $10^{-5}$ to $5\times10^{31\ 5}$ mole based on 1 mole of the silver halide.

The silver halide emulsion used in the present invention preferably is a silver bromide, silver iodobromide, silver iodochlorobromide, silver chlorobromide or silver chloride emulsion.

The shape of the silver halide grain in the photographic emulsion may be either in the form of a regular crystal such as cube and octahedron or in the form of an irregular crystal such as globular shape and tabular shape. The shape of the grain may be complex of these crystals. A mixture of these crystals is also available. The regular crystal is particularly preferred.

The silver halide grain may have either a homogeneous structure or a heterogeneous structure in which halogens located at the inside and the outside are different from each other. The silver halide grain may have a layered structure in which iodide contents in the inside layer and the outside layer are different from each other (particularly the iodide content in the inside layer is larger than in the outside layer). A latent image may be mainly formed either at the surface of the grain (a negative emulsion) or at the inside of the grain (an internal latent image emulsion or a direct reversal emulsion). A latent image is preferably formed at the surface of the grain.

The silver halide emulsion used in the invention preferably is a tubular grain emulsion in which tubular silver halide grains having a thickness of not more than 0.5 μm (preferably not more than 0.3 μm), a diameter of not more than 0.6 μm and a mean aspect ratio of not less than 5 are contained in an amount of 50% or more based on the total projected area of all the grains. Further, the silver halide emulsion used in the invention preferably is a monodispersed emulsion having such an almost uniform grain size distribution that a statistic coefficient of variation is not more than 20%. The coefficient of variation (S/d) is determined by dividing a standard deviation (S) by a diameter (d), which is determined by approximating the projected area of the grain to a circle. A mixture of the tubular grain emulsion and the monodispersed emulsion is also available.

The photographic emulsion used in the invention can be prepared by processes as described in P. Glafkides, Chimie er Physique Photographeque (Paul Monter Co., 1967); G. F. Duffin, Photographic Emulsion Chemistry (Focal Press, 1966); and V. L. Zelikman et al, Making and Coating Photographic Emulsion (Focal Press, 1964).

The above-mentioned silver halide solvent can be used to control the grain growth during formation of the silver halide grains.

At the stage for formation of the silver halide grains or physical ripening thereof, a cadmium salt, a zinc salt, a thallium salt, an iridium salt (or its complex salt), a rhodium salt (or its complex salt) or an iron salt (or its complex salt) can be added to the emulsion.

A hydrophilic colloid is used as a binder or a protective colloid for the emulsion layer or an intermediate layer of the photographic material of the invention. Gelatin is an advantageous hydrophilic colloid. The other protective colloids are also available. Examples of the other protective colloids include proteins such as a gelatin derivative, a graft polymer of gelatin and another polymer, albumin and casein; saccharide derivatives such as a cellulose derivative (e.g., hydroxyethyl cellulose, carboxymethyl cellulose and cellulose sulfate), sodium alginate and a starch derivative; and synthetic hydrophilic homopolymers or copolymers such as polyvinyl acetal, a partial acetal of polyvinyl alcohol, poly-N-vinylpyrrolidone, polyacrylic acid, polymethacrylic acid, polyacrylamide, polyvinyl imidazole and polyvinyl pyrazole.

Examples of gelatin used for the layers include general-purpose lime-processed gelatin, acid-processed gelatin and oxygen-processed gelatin. The oxygen-processed gelatin is described in Bull. Soc. Phot. Japan, No. 16, pp. 30 (1980). A hydrolysis product of gelatin is also available.

The hydrophilic colloidal layer of the photographic material can contain an inorganic or organic hardening agent. Examples of the hardening agent include a chromium salt, an aldehyde (e.g., formaldehyde, glyoxal and glutaraldehyde) and an N-methylol compound (e.g., dimethylol urea). An active halogen compound and an active vinyl compound are also available, and are preferably used because they give a stable photographic property to the photographic material. Examples of the active halogen compound include 2,4-dichloro-6-hydroxy-1,3,5-triazine and sodium salt thereof. Examples of the active vinyl compound include 1,3-bisvinylsulfonyl-2-propanol, 1,2-bis(vinylsulfonylacetamide)ethane, bis(vinylsulfonylmethyl)ether, and a vinyl polymer having vinylsulfonyl group on its side chain. Also preferred are an N-carbamoylpyrizinium salt (e.g., 1-morpholinocarbonyl-3-pyrizinio)methanesulfonate) and a haloamizinium salt (e.g., 1-(1-chloro-1-pyrizinomethylene)pyrrolizinium 2-naphthalenesulfonate), which quickly harden the layers.

The silver halide photographic emulsion used in the invention can be spectrally sensitized by a sensitizing dye. Examples of the sensitizing dye include a methine dye, a cyanine dye, a merocyanine dye, a complex cyanine dye, a complex merocyanine dye, a holopolar cyanine dye, a hemicyanine dye, a styryl dye and a hemioxonol dye. A cyanine dye, a merocyanine dye and a complex merocyanine dye are particularly preferred.

Those dyes have a basic heterocyclic ring, which is generally contained in the cyan dye. Examples of the ring include a pyrroline ring, an oxazoline ring, a thiazoline ring, a pyrrole ring, an oxazole ring, a thiazole ring, a serenazole ring, an imidazole ring, a tetrazole ring and a pyridine ring. Further, an alicyclic hydrocarbon ring or an aromatic hydrocarbon ring may be condensed with the above-described ring. Examples of the condensed ring include an indolenine ring, a benzindolenine ring, an indole ring, a benzoxazole ring, a naphthooxazole ring, a benzthiazole ring, a naphthothiazole ring, a benzserenazole ring, a benzimidazole ring and a quinoline ring. These rings may have a substituent group which is attached to the carbon atom of the rings.

The merocyanine dye or the complex merocyanine dye can contain a five-membered or six-membered heterocyclic ring having a ketomethylene structure such as a pyrazoline-5-one ring, thiohydantoin ring, a 2-thiooxazolidine-2,4-dione ring, a thizolidine-2,4-dione ring, a rhodanine ring and a thiobarbituric acid ring.

The sensitizing dyes can be used singly or in combination. A combination of the sensitizing dyes is often used for supersensitization. In addition to the sensitizing dyes, a supersensitizer can be contained in the photographic emulsion. The supersensitizer does not per se exhibit a spectral sensitization effect or does not substantially absorb visible light, but shows a supersensitizing activity. Examples of the supersensitizer include an aminostylbenzene compound substituted with a nitrogen-containing heterocyclic group, a condensate of an aromatic organic acid with formaldehyde, a cadmium salt, an azaindene compound and a combination thereof. A combination of the supersensitizers is particularly preferred. The aminostylbenzene compound is described in U.S. Pat. No. 2,933,390 and No. 3,635,721. The condensate of an aromatic organic acid and formaldehyde is described in U.S. Pat. No. 3,743,510. The combination of the supersensitizers is described in U.S. Pat. No. 3,615,613, No. 3,615,641, No. 3,617,295 and No. 3,635,721.

The silver halide emulsion may contain an antifogging agent or a stabilizer. The antifogging agent prevents occurrence of a fog. The stabilizer has a function of stabilizing the photographic property. The antifogging agent and the stabilizer function in preparation, storage or processing stage of the photographic material. Examples of the antifogging agent and stabilizer include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (e.g., 1-phenyl-5-mercaptotetrazole); mercaptopyrimidines; mercaptotriazines; thioketone compounds such as oxazolinethione; azaindenes such as triazaindenes, tetraazaindenes (e.g., 4-hydroxy-substituted (1,3,3a,7)tetraazaindenes) and pentaazaindenes; and amides such as benzenethiosulfonic amide, benzenesulfinic amide and benzenesulfonic amide.

The photographic material of the present invention may contain a surface active agent to improve various properties such as a coating property, an antistatic property, a slip property, an emulsifying or dispersing property, an antitacking property and photographic properties (e.g., development acceleration, high contrast and sensitization).

The hydrophilic colloidal layer of the photographic material may contain a water-soluble dye. The water-soluble dye has various functions such as a function of antiirradiation or a function of antihalation as well as a function as a filter dye. Examples of the dye include an oxonol dye, a hemioxonol dye, a styryl dye, a merocyanine dye, an anthraquinone dye, an azo dye, a cyanine dye, an azomethine dye, a triallymethane dye and a phthalocyanine dye. Further, an oil-soluble dye can be also added to the hydrophilic colloidal layer by emulsifying the dye in water by a known oil droplet dispersing method.

The photographic material of the invention can be used as a multi-layered multicolor photographic material provided with two or more light-sensitive layers which have different spectral sensitivities on a support. The multilayered color photographic material generally has at least one red-sensitive emulsion layer, at least one green-sensitive emulsion layer and at least one blue-sensitive emulsion layer on the support. The arrangement of those layers can be optionally determined. Preferably, the red.sensitive layer, the green sensitive layer and the blue sensitive layer are arranged from the support side in this order. The blue-sensitive layer, the green-sensitive layer and the red.sensitive layer may be arranged in this order from the support side. Further, the blue-sensitive layer, the red.sensitive layer and the green-sensitive layer may be arranged in this order from the support side. Further, two or more emulsion layers which are sensitive to the same color but show different sensitivities can be provided to enhance the sensitivity. Three emulsion layers can be provided to improve the graininess of the image. A non-light sensitive layer may be interposed between two or more emulsion layers having the same color sensitivity. Otherwise, between two or more emulsion layers having the same color sensitivity may be interposed another emulsion layer having a different color sensitivity. A light-reflecting layer such as a layer of silver halide grains can be provided under a high sensitive layer, particularly a high blue sensitive layer, to enhance the sensitivity.

The red sensitive emulsion layer generally contains a cyan coupler, the green sensitive emulsion layer generally contains magenta coupler, and the red sensitive emulsion layer generally contains a yellow color-forming coupler. However, other combinations are also available. For example, an infrared sensitive layer can be used to prepare a false color film or a film for exposure to a semiconductor laser beam.

Various color couplers can be used for the invention. Concrete examples of the couplers are described in the patents cited in Research Disclosure No. 17643, VII C-G.

As a yellow coupler, preferred are those described in, for example, U.S. Pat. No. 3,933,501, No. 4,022,620, No. 4,326,024, No. 4,401,752 and No. 4,248,961, Japanese Patent Publication No. 58(1983)-10739, and British Patents No. 1,425;020 and No. 1,476,760.

As a magenta coupler, 5-pyrazolone type and pyrazoloazole type compounds are preferred, and particularly preferred are those described in U.S. Pat. No. 4,310, 619 and No. 4,351,897, European Patent No. 73,636, U.S. Pat. No. 3,061,432 and No. 3,725,067, Research Disclosure No. 24220 (June, 1984), Japanese Patent Provisional Publication No. 60(1985)-33552, Research Disclosure No. 24230 (June, 1984), Japanese Patent Provisional Publications No. 60(1985)-43659, U.S. Pat. No. 4,500,630 and No. 4,540,654.

As a cyan coupler, there can be mentioned phenol type and naphthol type couplers, and preferred examples are those described in U.S. Pat. No. 4,052,212, No. 4,146,396, No. 4,228,233, No. 4,296,200, No. 2,369,929, No. 2,801,171, No. 2,772,162, No. 2,895,826, No. 3,772,002, No. 3,758,308, No. 4,334,011 and No. 4,327,173, West German Patent Publication No. 3,329,729, European Patents No. 121,365A and No. 161,626A, and U.S. Pat. No. 3,446,622, No. 4,333,999, No. 4,775,616, No. 4,451,559, No. 4,427,767, No. 4,690,889, No. 4,254,212 and No. 4,296,199.

A colored coupler may be used to compensate incidental absorption of a formed dye. The colored coupler is described in Research Disclosure No. 17643, VII-G, U.S. Pat. No. 4,163,670, Japanese Patent Publication No. 57(1982)-39413, U.S. Pat. No. 4,004,929 and No. 4,138,258, and British Patent No. 1,146,368.

As a coupler which gives a color developing dye exhibiting a proper diffusion, preferred are those described in U.S. Pat. No. 4,366,237. British Patent No. 2,125,570, European Patent No. 96,570, and West German Patent Publication No. 3,234,533.

Typical examples of polymerized dye-forming couplers are described in U.S. Pat. No. 3,451,820, No. 4,080,211, No. 4,367,282, No. 4,409,320 and No. 4,576,910, and British Patent No. 2,102,173.

A coupler which releases a photographically useful residue according to a coupling reaction can be also used in the invention. A DIR coupler which releases a development inhibitor is available. The DIR coupler is described in Research Disclosure No. 17643, VII-F, Japanese Patent Provisional Publications No. 57(1982)-151944, No. 57(1982)-154234, No. 60(1985)-184248 and No. 63(1988)-37346, and U.S. Pat. No. 4,248,962.

A coupler which imagewise releases a nucleating agent or a development accelerator in a development process is also available. This coupler is described in British Patents No. 2,097,140 and No. 2,131,188, and Japanese Patent Provisional Publications No. 59(1984)-157638 and No. 59(1984)-170840.

Examples of other couplers available for the photographic material of the invention include a competing coupler, a polyvalent coupler, a DIR redox compound-releasing coupler, a DIR coupler-releasing coupler, a DIR coupler-releasing redox compound, a DIR redox-releasing redox compound, a coupler which releases a dye having restoration to original color after an elimination reaction, a bleach accelerator-releasing coupler and a coupler which releases ligand. The competing coupler is described in U.S. Pat. No. 4,130,427. The polyvalent coupler is described in U.S. Pat. No. 4,283,472, No. 4,338,393 and No. 4,310,618. The DIR redox compound-releasing coupler, the DIR coupler-releasing coupler, the DIR coupler-releasing redox compound and the DIR redox-releasing redox compound are described in Japanese Patent Provisional Publications No. 60(1985)-185950 and No. 62(1987)-24252. The coupler which releases a dye having restoration to original color after elimination is described in European Patent No. 173,302A. The bleach accelerator-releasing coupler is described in Research Disclosure No. 11449, ibid. No. 24241, and Japanese Patent Provisional Publication No. 61(1986)-201247. The coupler which releases ligand is described in U.S. Pat. No. 4,553,477.

The couplers used in the invention can be introduced into the photographic material by various known dispersing methods.

Examples of a high-boiling solvent used in an O/W dispersing method are described in U.S. Pat. No. 2,322,027.

Examples of the high-boiling organic solvent having a boiling point of not lower than 175° C. under a normal pressure used in the O/W dispersing method include phthalates (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl-)isophthalate, bis(1,1-diethylpropyl)phthalate); esters of phosphoric acid or phosphonic acid (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate); benzoates (e.g., 2--ethylhexyl benzoate, dodecyl benzoate, 2-ethylehecyl-p-hydroxybenzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributylate, isostearyl lactate, trioctyl citrate); aniline derivatives (e.g., N,N-dibutyl-2-butoxyl-5-tert-octylaniline); and hydrocarbons (e.g., paraffin, dodecyl benzene, diisopropyl naphthalene). An organic solvent having a boiling point of not lower than about 30° C. preferably in the range of 50° C. to about 160° C. can be used as an auxiliary solvent. Examples of the auxiliary solvent include ethyl acetate, butyl acetate, ethyl propionate, methyl ethyl ketone, cyclohexanone, 2-ethoxyethyl acetate and dimethylformamide.

A process of a latex dispersing method, effects thereof and concrete examples of latex for impregnation are described in U.S. Pat. No. 4,199,363, West German Patent Applications (OLS) No. 2,541,274 and No. 2,541,230.

There is no specific limitation on the support on which the above-mentioned silver halide emulsion layer is provided. As the support materials, there can be employed flexible materials which are generally used for known photographic materials, such as plastic films, papers and cloths; and rigid materials such as glass, ceramics and metals. Preferred examples of the flexible support materials include semi-synthetic or synthetic polymers such as cellulose nitrate, cellulose acetate, cellulose butyl acetate, polystyrene, polyvinyl chloride, polyethylene terephthalate and polycarbonate; baryta papers; and other papers coated or laminated with α-olefin polymers (e.g., polyethylene, polypropylene or ethylene-butene copolymer). The support may be colored with dyes or pigments. Further, the support may be made black for light-blocking. The surface of the support is generally subjected to undercoating treatment for enhancing the adhesion with the photographic emulsion layer. The surface of the support may be further subjected to other various treatments such as glow discharge, corona discharge, irradiation with ultraviolet rays and flame treatment before or after the undercoating treatment.

The photographic emulsion layer and the hydrophilic colloidal layer can be coated on the support by a known coating method such as dip coating, roller coating, flood coating and extrusion coating. If desired, two or more layers can be simultaneously coated by the coating methods as described in U.S. Pat. No. 2,681,294, No. 2,761,791, No. 3,526,528 and No. 3,508,947.

The photographic material of the invention can be used as a monochromatic or color photographic material. Concretely, it can be used as color negative films for domestic use or cinematographic use; and other films or papers for slide projection use or television use, such as color reversal films, color papers, color positive films and color reversal papers. Further, the photographic material of the invention can be also used as monochromatic light-sensitive materials for X-rays by using a mixture of three-color couplers described in "Research Disclosure" No. 17,123, (July, 1978), or using black color-forming coupler described in U.S. Pat. No. 4,126,461 and British Patent No. 2,102,136. Moreover, the photographic material of the invention can be also used as films for plate making (e.g., lithographic films and scanner films), X-ray films for medical use or industrial use, monochromatic negative films for picture-taking, monochromatic photographic papers, microfilms for COM use or domestic use, and other light-sensitive printing materials.

The photographic material of the present invention can be used in a color diffusion transfer process. The color diffusion transfer process can be classified into a peel apart type, an integrated type and a film unit type which does not require peeling. The integrated type is described Japanese Patent Publications No. 46(1971)-16356 and No. 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be provided in the color diffusion transfer photographic material. These layers have a function of allowing a broad latitude of the processing temperature.

The photographic light-sensitive material of the invention is used by an exposure process, a development process and a fixing process. Use of the photographic light-sensitive material of the present invention is described below.

Various exposure means can be employed in the exposure process. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, flash light sources (e.g., electric flash and metal-burning flashbulb). Light sources which emit light in the ultraviolet to infrared region can be also used as the recording light sources. For example, there can be mentioned gasses, dye solutions, semiconductor lasers, light emission diode, and plasma light source. Also employable are fluorescent surface given by the stimulated phosphor with electron rays (e.g., CRT) and an exposure means in which a microshutter array using liquid crystal (LCD) or lanthanum-doped lead zirconate titanate (PLZT) is combined with a linear or plane-like light source. If necessary, spectral distribution used in the exposure process can be appropriately adjusted by color filters.

A color developing solution used in the development process of the photographic material according to the invention preferably is an alkaline aqueous solution mainly containing an aromatic primary amine-color developing agent. As the color developing agents, aminophenol compounds and p-phenylenediamine compounds are preferably employed. Examples of the p.phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline, 3-methyl-4-amino-N-ethyl-N-β-methoxyethylaniline; and sulfates, chlorides and p-toluenesulfonates of those compounds. Generally, salts of diamines are more preferably employed than free diamines, because they show higher stability than free diamines.

The color developing solution generally contains pH buffering agents (e.g., carbonates of alkali metals, borates thereof and phosphates thereof), development inhibitors (e.g., bromides, iodides, benzimidazoles, benzothiazoles and mercapto compounds) or anti-fogging agents. If necessary, the color developing solution may further contain other additives such as preservatives (e.g., hydroxylamine and sulfite), organic solvents (e.g., triethanol amine and diethylene glycol), development accelerators (e.g., benzyl alcohol, polyethylene glycol, quarternary ammonium salts and amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid and phosphonocarboxylic acid), and antioxidants described in West German Patent Application (OLS) No. 2,622,950.

In the development process of color reversal photographic materials, color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). Those monochromatic developing agents can be employed singly or in combination.

The photographic emulsion layer is generally subjected to bleaching process after the color development process. The bleaching process may be done simultaneously with a fixing process or separately from the fixing process. For the rapid processing, a bleach-fix process can be made after the bleaching process. As the bleaching agents, there can be used polyvalent metal compounds such as iron (III), cobalt (III), chromium (IV) and copper (II), peracids, quinones, and nitroso compounds. Representative examples of the bleaching agents include ferricyanides; dichromates; organic complex salts of iron (III) or cobalt (III) such as complex salts of aminopolycarboxylic acids (e.g., ethylenediaminetetraacetic acid, diethylenetriaminepentaacetic acid, nitrilotriacetic acid and 1,3-diamino-2-propanoltetraacetic acid) and complex salts of citric acid, tartaric acid and malic acid; persulfates; manganates; and nitrosophenol. Among them, ethylenediaminetetraacetic acid iron (III) salt, diethylenetriaminepentaacetic acid iron (III) salt and persulfate are preferred from the viewpoints of rapid processing and prevention of environmental pollution. Also preferred is ethylenediaminetetraacetic acid iron (III) complex salt in each of an individual bleaching solution (bleaching bath) and in a bleach fix bath. A bleaching accelerator can be optionally used in the bleaching bath, the bleach fix bath or the prior bath to those baths. Examples of the effective bleaching accelerators include compounds having mercapto group or disulfide group as described in U.S. Pat.

No. 3,893,858, West German Patents No. 1,290,812 and No. 2,059,988, Japanese Patent Provisional Publications No. 53(1978)-32736, No. 53(1978)-57831, No. 53(1978)-37418, No. 53(1978)-65732, No. 53(1978)-72623, No. 53(1978)-95630, No. 53(1978)-95631, No. 53(1978)-104232, No. 53(1978)-124424, No. 53(1978)-141623 and No. 53(1978)-28426, and Research Disclosure No. 17129 (July, 1978); thiazolidine derivatives as described in Japanese Patent Provisional Publication No. 50(1975)-140129; thiourea derivatives as described in Japanese Patent Publication No. 45(1970)-8506, Japanese Patent Provisional Publications No. 52(1977)-20832 and No. 53(1978)-32735, and U.S. Pat. No. 3,706,561; iodides as described in West German Patent No. 1,127,715 and Japanese Patent Provisional Publication No. 58(1983)-16235; polyethylene oxides as described in West German Patents No. 966,410 and No. 2,748,430; polyamine compounds as described in Japanese Patent Publication No. 45(1970)-8836; and compounds as described in Japanese patent Provisional Publications No. 49(1974)-42434, No. 49(1974)-59644, No. (1978)-94927, No. 54(1979)35727, No. 55(1980)-26506 and No. 58(1983)-163940. In addition to the above-mentioned compounds, iodine ion and bromine ion can be also employed as the bleaching accelerator. As the bleaching accelerator, preferred are compounds having mercapto group or disulfide group because these compounds show high acceleration effects, and particularly preferred are compounds described in U.S. Pat. No. 3,893,858, West German Patent No. 1,290,812 and Japanese Patent Provisional Publication No. 53(1978)-95630. Also preferred are compounds described in U.S. Pat. No. 4,552,834. The above-mentioned bleaching accelerators may be contained in the photographic material. Employment of the bleaching accelerators is particularly effective in the bleach-fix process of color photographic materials for picture taking.

Examples of fixing agents include thiosulfates, thiocyanates, thioether compound, thioureas, and iodides. Of these, thiosulfates are generally used. As the bleach-fix bath or the preservative, sulfites, bisulfites and carbonylbisulfurous acid addition products are preferably employed.

After the bleach-fix process or the fixing process, the photographic light-sensitive material is generally subjected to washing with water and stabilization. In the washing stage or the stabilization stage, a variety of known compounds can be used for preventing precipitation and saving water. For example, there can be used hard water-softening agents for preventing the precipitation, such as inorganic phosphoric acids, aminopolycarboxylic acids, organic aminopolyphosphoric acids and organic phosphoric acids; germicides, mildewcides and metal salts (e.g., magnesium salts, aluminum salts and bismuth salts) for preventing various bacteria, alga and mildew; surface active agents for preventing drying strain or drying mark; and various hardeners for film-hardening. Otherwise, compounds described in L. E. West, Photographic Science And Engineering, Vol. 6, pp 344–359, (1955) can be also employed. Particularly preferred are chelating agents and mildewcides.

In the washing process, countercurrent washing using two or more baths is generally employed to save water. Instead of the washing process, multi-stage countercurrent stabilizing process can be used, and in this case, 2–9 countercurrent baths are required. To the stabilizing baths are added various compounds to stabilize resulting images in addition to the above-mentioned additives. Examples of the compounds include various buffering agents for adjusting pH value of the resulting films (for example, adjusting to pH of 3–9), and aldehydes (e.g., formalin). Examples of the buffering agents include borates, methaborates, sodium tetraborate decahydrates, phosphates, carbonates, potassium hydroxide, sodium hydroxide, ammonia water, monocarboxylic acids, dicarboxylic acids and polycarboxylic acids, in appropriate combination. Further, if desired, other additives such as chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, irithiazorone, 4-thiazolinebenzimidazole, halogenated phenol, sulfanylamide and benzotriazole), surface active agents, brightening agents and hardeners can be also employed. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the treating conditions, but generally is in the range of 20 seconds to 10 minutes, preferably in the range of 20 seconds to 5 minutes.

The silver halide color photographic material can contain a color developing agent for simple processing and rapid processing. For incorporation of the color developing agent, various precursors releasing the color developing agents can be preferably employed. Examples of the precursors employable for the purpose include indolenine compounds as described in U.S. Pat. No. 3,342,597; Shchiff's base type compounds as described in U.S. Pat. No. 3,342,599 and Research Disclosure, Nos. 14,850 and 15159; aldol compounds as described in Research Disclosure, No. 13,924; metal complex salts as described in U.S. Pat. No. 3,719,492; urethane compounds as described in Japanese Patent Provisional Publication No. 53(1978)-135628; and other salt type precursors as described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

Into the silver halide color photographic material may be incorporated 1-phenyl-3-pyrazolidones to accelerate color development. Typical compounds used for the purpose are described for example in Japanese Patent Provisional Publications No. 56(1981)-64339, No.

57(1982)-144547, No. 57(1982)-211147, No. 58(1983)-50532, No. 58(1983)-50533, No. 58(1983)-50534, No. 58(1983)-50535, No. 58(1983)-50536 and No. 58(1083)-115438.

The various baths (solutions) used in the above-mentioned processes generally can have a temperature in the range of 10° to 50° C. The temperature generally is in the range of 33° to 38° C., but it can be made higher to accelerate the processing to shorten the processing time. Otherwise, it can be made lower to improve qualities of the resulting images or to enhance the stability of the baths. Further, cobalt intensification described in West German Patent No. 2,226,770 or hydrogen peroxide intensification described in U.S. Pat. No. 3,674,499 can be made to save the silver of the photographic material.

The above-mentioned various baths may be equipped with a heater, a temperature sensor, a liquid level sensor, a circulating pump, a filter, a floating lid or a squeegee, if desired.

In the continuous processing, a replenisher for each bath can be used to prevent the bath composition from varying, whereby a uniform finish can be obtained. The replenisher can be used in an amount of half of the standard amount or smaller amount than half of the standard amount to reduce the cost.

When the photographic material of the invention is used as a color paper, the above-mentioned bleach-fix process is generally made, and when the photographic material of the invention is used as a color photographic material for picture-taking, the same process is made according to the necessity.

The present invention is further described by the following examples.

EXAMPLE 1

To 1 l of aqueous gelatin solution containing 0.36 mole of potassium bromide and 41 g of gelatin while stirring at 75° C. were added aqueous silver nitrate solution containing 34.2 g of $AgNO_3$ and aqueous potassium iodide solution containing 25.5 g of KBr over a period of 18 minutes according to an accelerating rate method wherein the last rate is 7 times as the first rate. To the mixture was further added 2.7 g of potassium bromide. To the resulting mixture were added aqueous silver nitrate solution containing 142 g of $AgNO_3$ and aqueous potassium iodide solution containing 2.4 M/l of KBr over a period of 70 minutes according to an accelerating rate method wherein the last rate is 13.2 times as the first rate and the silver potential was kept to saturation calomel electrode minus 50 mV.

After the grain formation, the emulsion was desalted according to a conventional flocculation method and washed with water. Then gelatin and water were added to the emulsion.

Thus, a monodispersed octahedral silver bromide emulsion was prepared. The emulsion has mean grain size of 0.8 μm. The distribution coefficient of the grain size was 6.5%.

The obtained emulsion was divided into 3 parts. Each part was adjusted to the pH values set forth in Table 1 (pAg was 8.6). Each part was further divided into many samples. To each sample was added the sensitizer set forth in Table 1 at 50° C. Each sample was sensitized for the time set forth in Table 1.

After pH was adjusted to 6.3, gelatin, 4-hydroxy-6-methyl-1,3,3a,7-tetrazaindene, potassium polystyrenesulfonate and sodium dodecylbenzensulfonate were added to the samples to prepare coating solutions.

On a cellulose triacetate film was provided an undercoating layer to prepare a support. On the support were coated the above-prepared coating solution for the emulsion layer and a coating solution for a protective layer containing gelatin, polymethyl methacrylate particles and sodium salt of 2,4-dichloro-6-hydroxy-s-triazine simultaneously according to a pressing out method.

Each of the prepared samples was exposed to sensitometry light through an optical wedge for 1 second, and was developed with the following developing solution MAA-1 at 20° C. for 10 minutes. After the development was stopped, the samples were fixed, washed with water and dried according to a conventional method. Then, the density of the sample was measured. The results are set forth in Table 1.

In Table 1, the relative sensitivity is a relative reciprocal value of the exposure required to obtain an optical density of the fogging value plus 0.2. The relative value is defined in the manner that the value of the sample sensitized with the sensitizer (A) at pH of 6.3 for 60 minutes is 100.

TABLE 1

| Sensitizer | | Relative Sensitivity (sensitizing time) | | | | | | | | |
|---|---|---|---|---|---|---|---|---|---|---|
| | Amount (mol per 1 mol of | 40 minutes (pH) | | | 60 minutes (pH) | | | 80 minutes (pH) | | |
| No. | AgX) | 5.8 | 6.3 | 6.8 | 5.8 | 6.3 | 6.8 | 5.8 | 6.3 | 6.8 |
| (A) | $1.6 \times 10^{-5}$ | 66 | 70 | 73 | 98 | 100 | 100 | 100 | 89 | 86 |
| (B) | $8 \times 10^{-6}$ | 63 | 91 | 100 | 87 | 100 | 87 | 100 | 89 | 72 |
| (C) | $8 \times 10^{-6}$ | 55 | 86 | 100 | 82 | 100 | 88 | 95 | 92 | 83 |
| (D) | $8 \times 10^{-6}$ | 59 | 97 | 107 | 92 | 107 | 92 | 105 | 95 | 80 |
| (1) | $8 \times 10^{-6}$ | 91 | 102 | 102 | 103 | 107 | 107 | 107 | 103 | 103 |
| (2) | $8 \times 10^{-6}$ | 81 | 94 | 96 | 97 | 100 | 100 | 100 | 96 | 96 |
| (3) | $12 \times 10^{-6}$ | 84 | 100 | 100 | 102 | 105 | 105 | 105 | 101 | 101 |
| (9) | $8 \times 10^{-6}$ | 79 | 90 | 94 | 95 | 100 | 100 | 100 | 96 | 96 |

Comparative sensitizer (A)
Sodium thiosulfate
Comparative sensitizer (B)
N,N'-diphenylthiourea
Comparative sensitizer (C)
N-phenylthioacetamide
Comparative sensitizer (D)
5-Benzylidene-N-ethylrhodanine.

Developing solution (MAA-1)

| | |
|---|---|
| Methol | 2.5 g |
| Ascorbic acid | 10 g |

TABLE 1-continued

| | |
|---|---|
| $Na_2B_4O_7.5H_2O$ | 35 g |
| Potassium bromide | 1 g |
| Water | to make up to 1 l |

As is evident from the results set forth in Table 1, the samples of the present invention show a constant sensitivity even if the pH of the emulsion is changed, compared with the samples using conventional sensitizers (B), (C) and (D).

EXAMPLE 2

Silver bromide emulsion was prepared in the same manner as in Example 1. The emulsion was divided into 3 parts. Each part was adjusted to the pAg values set forth in Table 2 (pAg was 6.30). Each part was further divided into many samples. To each sample was added the sensitizer set forth in Table 2 at 50° C. Each sample was sensitized for the time set forth in Table 2.

After pAg was adjusted to 8.60, photographic materials were prepared and evaluated in the same manner as in Example 1. The results are set forth in Table 2.

In Table 2, the relative sensitivity is defined in the manner that the value of the sample sensitized with the sensitizer (A) at pAg of 8.6 for 60 minutes is 100.

TABLE 2

| Sensitizer | | Relative Sensitivity (sensitizing time) | | | | | | | | |
|---|---|---|---|---|---|---|---|---|---|---|
| | Amount (mol per 1 mol of | 40 minutes (pAg) | | | 60 minutes (pAg) | | | 80 minutes (pAg) | | |
| No. | AgX) | 8.1 | 8.6 | 9.1 | 8.1 | 8.6 | 9.1 | 8.1 | 8.6 | 9.1 |
| (A) | $1.6 \times 10^{-5}$ | 66 | 70 | 73 | 98 | 100 | 100 | 100 | 89 | 86 |
| (B) | $8 \times 10^{-6}$ | 63 | 91 | 100 | 87 | 100 | 87 | 100 | 89 | 72 |
| (C) | $8 \times 10^{-6}$ | 55 | 86 | 100 | 82 | 100 | 88 | 95 | 92 | 83 |
| (D) | $8 \times 10^{-6}$ | 59 | 97 | 107 | 92 | 107 | 92 | 105 | 95 | 80 |
| (1) | $8 \times 10^{-6}$ | 91 | 102 | 102 | 103 | 107 | 107 | 107 | 103 | 103 |
| (2) | $8 \times 10^{-6}$ | 81 | 94 | 96 | 97 | 100 | 100 | 100 | 96 | 96 |
| (3) | $12 \times 10^{-6}$ | 84 | 100 | 100 | 102 | 105 | 105 | 105 | 101 | 101 |
| (9) | $8 \times 10^{-6}$ | 79 | 90 | 94 | 95 | 100 | 100 | 100 | 96 | 96 |

As is evident from the results set forth in Table 2, the samples of the present invention show a constant sensitivity even if the pAg of the emulsion is changed, compared with the samples using conventional sensitizer (A).

It is apparent from the results of Examples 1 & 2 that the photographic materials of the present invention have a constant high sensitivity even if pH or pAg conditions are changed.

EXAMPLE 3

To 1.2 l of 3.0 wt. % aqueous gelatin solution containing 0.06 mole of potassium bromide while stirring was added 30 ml of 25 wt. % aqueous solution of ammonia. The resulting mixture contained in a reaction vessel was kept at 65° C. To the mixture were added 50 ml of 0.3 mole silver nitrate solution and 50 ml of aqueous silver salt solution containing 0.063 mole of potassium iodide and 0.19 mole of potassium bromide over a period of 3 minutes according to a double jet method. Thus, silver iodobromide grains were formed as the core. The grains had the mean grain size of 0.15 μm as the diameter of the circle corresponding to the projected area. The silver iodide content was 25 mole %.

To the emulsion was further added 60 ml of an aqueous solution of ammonia at 65° C. in the same manner as is mentioned above. To the mixture were added 800 ml of 1.5 mole silver nitrate solution and 800 ml of aqueous silver salt solution containing 0.375 mole of potassium iodide and 1.13 mole of potassium bromide over a period of 80 minutes according to a double jet method to form the first coated layer of the silver halide grains. The obtained octahedral grains have mean grain size of 0.71 μm as the diameter of the circle corresponding to the projected area. The silver iodide content was 25 mole %.

The emulsion was neutralized with acetic acid. To the emulsion contained in a mixing vessel were added 1.5 mole silver nitrate solution and 1.5 mole potassium bromide solution to form the second coated layer (silver bromide shell) of the silver halide grains. Thus, a monodispersed (coefficient of variation: about 18%) octahedral core/shell emulsion was prepared. The grains had the mean grain size of 0.89 μm as the diameter of the circle corresponding to the projected area. The ratio of the first coated layer to the second coated layer was 1:1.

The emulsion was then cooled to 35° C., desalted according to a conventional flocculation method, and washed with water. To the emulsion were further added gelatin and water.

The obtained emulsion was divided into 3 parts. Each part was adjusted to the pH values set forth in Table 3 (pAg was 8.3). Each part was further divided into many samples. To each sample was added the sensitizer set forth in Table 3 at 56° C. To the sample was further added chloroauric acid ($8 \times 10^{-6}$ mole/l mole of silver halide) and potassium thiocyanate ($8 \times 10^{-4}$ mole/l mole of silver halide), and the sample was chemically sensitized for the time set forth in Table 3. After the pH was adjusted to 6.3, to the sample were added the following compounds to prepare a coating solution.

Magenta Coupler

3-{3-[2-(2,4-Di-tert-amylphenoxy)butylylamino]benzoylamino}-1-(2,4,6-trichlorophenyl)pyrazoline-5-on Oil Tricresylphosphate Stabilizer 4-Hydroxy-6-methyl-1,3,3a,7-tetrazeindene Antifogging Agent Monosodium salt of 1-(m-sulfophenyl)-5-mercaptotetrazole Coating Aid Sodium dodecylbenzenesulfonate Hardening Agent Sodium salt of 2,4-dichloro-6-hydroxy-S-triazine Antiseptic Phenoxyethanol On a triacetyl cellulose film was provided an undercoating layer to prepare a support. On the support were coated the above-prepared coating solution for the emulsion layer and a coating solution for a protective layer containing gelatin and polymethyl methacrylate particles simultaneously according to a pressing out method.

Each of the prepared samples was exposed to sensitometry light through an optical wedge for 1/100 second, and subjected to the following process at 38° C.

| | |
|---|---|
| 1. Color development | 2 minutes and 45 seconds |
| 2. Bleaching | 6 minutes and 30 seconds |
| 3. Washing | 3 minutes and 15 seconds |
| 4. Fixing | 6 minutes and 30 seconds |
| 5. Washing | 3 minutes and 15 seconds |
| 6. Stabilizing | 3 minutes and 15 seconds |

The compositions of the processing solution are set forth below.

| | |
|---|---|
| Color developing solution | |
| Sodium nitrilotriacetate | 1.0 g |
| Sodium sulfite | 4.0 g |
| Sodium carbonate | 40.0 g |
| Potassium bromide | 1.4 g |
| Sulfate salt of hydroxylamine | 2.4 g |
| Sulfate salt of 4-(N-ethyl-N-β-hydroxyethylamino)-2-methyl-aniline | 5.0 g |
| Water | to make up to 1 l |
| Bleaching solution | |
| Ammonium bromide | 160.0 g |
| Ammonia water (28%) | 25.0 ml |
| Sodium Fe(II) ethylenediaminetetraacetate | 130 g |
| Glacial acetic acid | 14 ml |
| Water | to make up to 1 l |
| Fixing solution | |
| Sodium tetrapolyphosphate | 2.0 g |
| Sodium sulfite | 4.0 g |
| Ammonium thiosulfate solution (70%) | 175.0 ml |
| Sodium bisulfite | 4.6 g |
| Water | to make up to 1 l |
| Stabilizing solution | |
| Formalin | 8.0 ml |
| Water | to make up to 1 l |

The density of the sample was measured through a green filter. The results are set forth in Table 3.

In Table 3, the relative sensitivity is a relative reciprocal value of the exposure required to obtain an optical density of the fogging value plus 0.2. The relative value is defined in the manner that the value of the sample sensitized with the sensitizer (A) at pH of 6.3 for 55 minutes is 100.

TABLE 3

| Sensitizer | | Relative Sensitivity (sensitizing time) | | | | | | | | | Fog |
|---|---|---|---|---|---|---|---|---|---|---|---|
| | Amount | 45 minutes (pH) | | | 55 minutes (pH) | | | 65 minutes (pH) | | | (55 min, pH |
| No. | (mol/1 mol of AgX) | 5.8 | 6.3 | 6.8 | 5.8 | 6.3 | 6.8 | 5.8 | 6.3 | 6.8 | 6.3) |
| (A) | $24 \times 10^{-6}$ | 74 | 79 | 83 | 100 | 100 | 100 | 110 | 98 | 92 | 0.21 |
| (D) | $12 \times 10^{-6}$ | 84 | 96 | 110 | 96 | 110 | 100 | 110 | 110 | 82 | 0.28 |
| (1) | $12 \times 10^{-6}$ | 90 | 92 | 104 | 110 | 110 | 110 | 110 | 110 | 106 | 0.20 |
| (2) | $12 \times 10^{-6}$ | 87 | 90 | 100 | 105 | 105 | 105 | 105 | 105 | 102 | 0.22 |

As is evident from the results using a gold sensitizer set forth in Table 3, the samples of the present invention show a constant high sensitivity even if the pH of the emulsion is changed. Further, the samples of the invention have a low fogging value.

EXAMPLE 4

Silver bromide emulsion was prepared in the same manner as in Example 3. The emulsion was divided into 2 parts. Each part was adjusted to the pH values set forth in Table 4 (pAg was 8.3). To each part was added the sensitizer set forth in Table 4 at 56° C. To the sample was further added chloroauric acid ($8\times10^{-6}$ mole/l mole of silver halide) and potassium thiocyanate ($8\times10^{-4}$ mole/l mole of silver halide), and the sample was chemically sensitized for 55 minutes. Then photographic materials were prepared and evaluated in the same manner as in Example 3. The results are set forth in Table 4.

In Table 4, the relative sensitivity is defined in the manner that the value of the sample sensitized with the sensitizer (1) at pH of 6.3 is 100.

TABLE 4

| | Sensitizer | Relative Sensitivity (pH) | | Fog (pH) | |
|---|---|---|---|---|---|
| No. | Amount (mol per 1 mol of AgX) | 6.3 | 7.5 | 6.3 | 7.5 |
| (1) | $1.2 \times 10^{-5}$ | 100 | 92 | 0.28 | 0.48 |
| (E) | $1.2 \times 10^{-5}$ | 32 | 85 | 0.12 | 0.43 |
| (F) | $1.2 \times 10^{-5}$ | 45 | 102 | 0.14 | 0.55 |
| (G) | $1.2 \times 10^{-5}$ | 51 | 110 | 0.18 | 0.45 |

Comparative sensitizer (E)

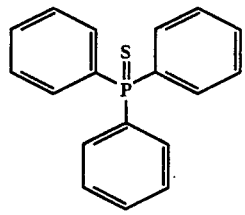

(Compound No. 4 disclosed in U.S. Pat. No. 4,115,129)

Comparative sensitizer (F)

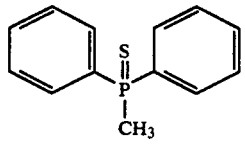

(Compound No. 14 disclosed in U.S. Pat. No. 4,115,129)

Comparative sensitizer (G)

TABLE 4-continued

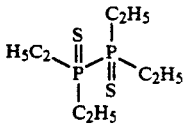

(Compound No. 3 disclosed in U.S. Pat. No. 4,115,129)

As is evident from the results set forth in Table 4, the samples using sensitizers disclosed in U.S. Pat. No. 4,115,129 are unstable when the pH value is changed. Accordingly, the sensitizers disclosed in U.S. Pat. No. 4,115,129 should be used at pH of not lower than 7. On the other hand, the samples of the present invention show a constant high sensitivity even if the pH of the emulsion is changed.

We claim:

1. A process for sulfur sensitization of a silver halide emulsion, wherein the silver halide emulsion is sensitized at a pH of lower than 7 with a compound represented by the formula (I), said process comprising the step of adding said compound to said silver halide emulsion:

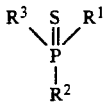

(I)

in which each of $R^1$, $R^2$ and $R^3$ independently is a group of chain structure selected from an alkyl group, an alkenyl group, an alkynyl group and an alkylthio group, each of which may have one or more substituent groups; and the number of the carbon atoms contained in the compound represented by the formula (I) is 3 to 12.

2. The process for sulfur sensitization as claimed in claim 1, wherein the silver halide emulsion is sensitized at a pAg in the range of 6 to 11.

3. The process for sulfur sensitization as claimed in claim 1, wherein the silver halide emulsion is sensitized at a temperature in the range of 40° to 95° C.

4. The process for sulfur sensitization as claimed in claim 1, wherein the compound represented by the formula (I) is used in an amount of $10^{-7}$ to $10^{-2}$ mol based on 1 mol of the silver halide.

5. The process for sulfur sensitization as claimed in claim 1, wherein each of $R^1$, $R^2$ and $R^3$ in formula (I) independently is a group of chain structure selected from an alkyl group, an alkenyl group and an alkynyl group.

6. The process for sulfur sensitization as claimed in claim 1, wherein each of $R^1$, $R^2$ and $R^3$ in formula (I) independently is a group of chain structure selected from an alkyl group and an alkenyl group.

7. The process for sulfur sensitization as claimed in claim 1, wherein each of $R^1$, $R^2$ and $R^3$ in formula (I) independently is an acyclic alkyl group.

8. The process for sulfur sensitization as claimed in claim 1, wherein the number of carbon atoms contained in the compound represented by formula (I) is 3 to 10.

9. The process for sulfur sensitization as claimed in claim 1, wherein the number of carbon atoms contained in the compound represented by formula (I) is 3 to 8.

10. The process for sulfur sensitization as claimed in claim 1, wherein the number of carbon atoms contained in the compound represented by formula (I) is 3 to 6.

11. The process for sulfur sensitization as claimed in claim 1, wherein each of $R^1$, $R^2$ and $R^3$ in formula (I) independently contains 1 to 4 carbon atoms.

* * * * *